United States Patent [19]

Alford

[11] Patent Number: 4,477,031

[45] Date of Patent: Oct. 16, 1984

[54] APPARATUS FOR READY CONVERSION OF CRUSHING CAVITY CONFIGURATION IN A CONE CRUSHER

[75] Inventor: Peter B. Alford, Cheshire, Oreg.

[73] Assignee: Iowa Manufacturing Company, Cedar Rapids, Iowa

[21] Appl. No.: 369,931

[22] Filed: Apr. 19, 1982

Related U.S. Application Data

[63] Continuation of Ser. No. 152,788, May 23, 1980, abandoned.

[51] Int. Cl.[3] ..... B02C 2/04

[52] U.S. Cl. ..... 241/211; 241/215

[58] Field of Search ..... 241/207-216, 241/286, 290

[56] References Cited

U.S. PATENT DOCUMENTS 2,147,833 2/1939 Fahrenwald ..... 241/215

2,832,547 4/1958 Kennedy ..... 241/215 X

*Primary Examiner*—Howard N. Goldberg

*Assistant Examiner*—Timothy V. Eley

*Attorney, Agent, or Firm*—Simmons, Perrine Albright & Ellwood

[57] ABSTRACT

A cone crusher features a "fine" head and a pair of adapters and associated mantles which allow conversion of the crusher from fine to coarse operation, or vice versa, without the need to change the head itself. Each adapter and its associated mantle can be put on or taken off the head as a unit.

11 Claims, 3 Drawing Figures

APPARATUS FOR READY CONVERSION OF CRUSHING CAVITY CONFIGURATION IN A CONE CRUSHER

CROSS REFERENCE TO RELATED APPLICATION

This is a continuation of application Ser. No. 152,788, filed May 23, 1980, now abandoned.

BACKGROUND OF THE INVENTION

Cone crushers, insofar as the material upon which they operate is concerned, are generally of two types, "standard" or "coarse" head and "fine" or "short" head. The former is used for larger material and possesses greater reduction ability than does the latter which is designed to produce finer material, something the coarse head type cannot efficiently accomplish. Two of the distinguishing characteristics of the coarse head crusher are the greater slant height of its head and the larger included angle between its mantle and bowl liner in order to accommodate larger material and to reduce it quickly. The fine or short head crusher is literally that, having a head whose slant height is less than that of the coarse head crusher as well as a smaller included angle between its mantle and bowl liner.

In the past, in order to alter a cone crusher from coarse to fine operation, the practice has been to replace the entire head and its mantle with a shorter head and mantle, as well, of course, to replace the bowl liner and frame. This, obviously, is an elaborate and time consuming operation, normally done in the field. One could, of course, have separate coarse and fine head crushers on hand, and this is not unusual in the case of smaller crushers, say, 36 inches, but in the case of the larger ones, say, 72 inches, that is usually a prohibitively expensive alternative inasmuch as a fine head is not needed nearly as often as a coarse head. There are other disadvantages, too. Besides requiring a lot of time and the need to have separate heads on hand in the field, the change from coarse to fine head, or vice versa, necessarily involves lifting the entire head out of the crusher and thus exposing its bearings to the entrance of grit and debris. Finally, not only the contractor in the field but also the manufacturer must suffer the expense and inconvenience of additional inventory by having to keep two types of heads in stock. Hence, the primary object of the present invention is to provide means by which the need, particularly in the case of the larger crushers, to change heads from coarse to fine or vice versa is eliminated, thus reducing time and inventory expense and avoiding bearing contamination.

SUMMARY OF THE INVENTION

The aim of the invention is accomplished by initially equipping each crusher with an essentially stock short or fine head, rather than a large coarse head, which is modified in minor respects to accept either of a pair of special adapters. One of the adapters is shorter than the other and fits over the head between it and the fine head mantle. The other, longer adapter lengthens, as it were, the slant height of the head and is disposed between it and the coarse mantle. Hold-down assemblies are employed at the top of the head for each adapter and its associated mantle to clamp the latter down onto the adapter. Each adapter in turn is also drawn down onto the head by four pairs of T-bolts, their heads engaging anchor blocks depending from the under surface of the adapter and received in openings in the head, the bolts being secured below through cross bars between adjacent webs supporting the skirt of the head. A pair of abutting lugs, one on the adapter and the other on the head, prevents rotation of the adapter relative to the head.

Accordingly, when changing from coarse to fine operation or vice versa and after removing the bowl liner and frame and releasing the T-bolts, essentially the mantle and adapter can then be simply lifted as a unit from the head and replaced with the other mantle and adapter as a unit. The head itself remains in place, its bearings undisturbed, and the entire operation can be completed in far less time than before, approximately four hours as opposed to eight. The change can readily be accomplished in the field, and the need no longer to have two separate heads on hand reduces inventory costs for the manufacturer and investment costs for the contractor. Other features and advantages will become apparent from the drawings and detailed description which follows.

DETAILED DESCRIPTION OF THE PREFERRED EMBODIMENT

Figure 1:
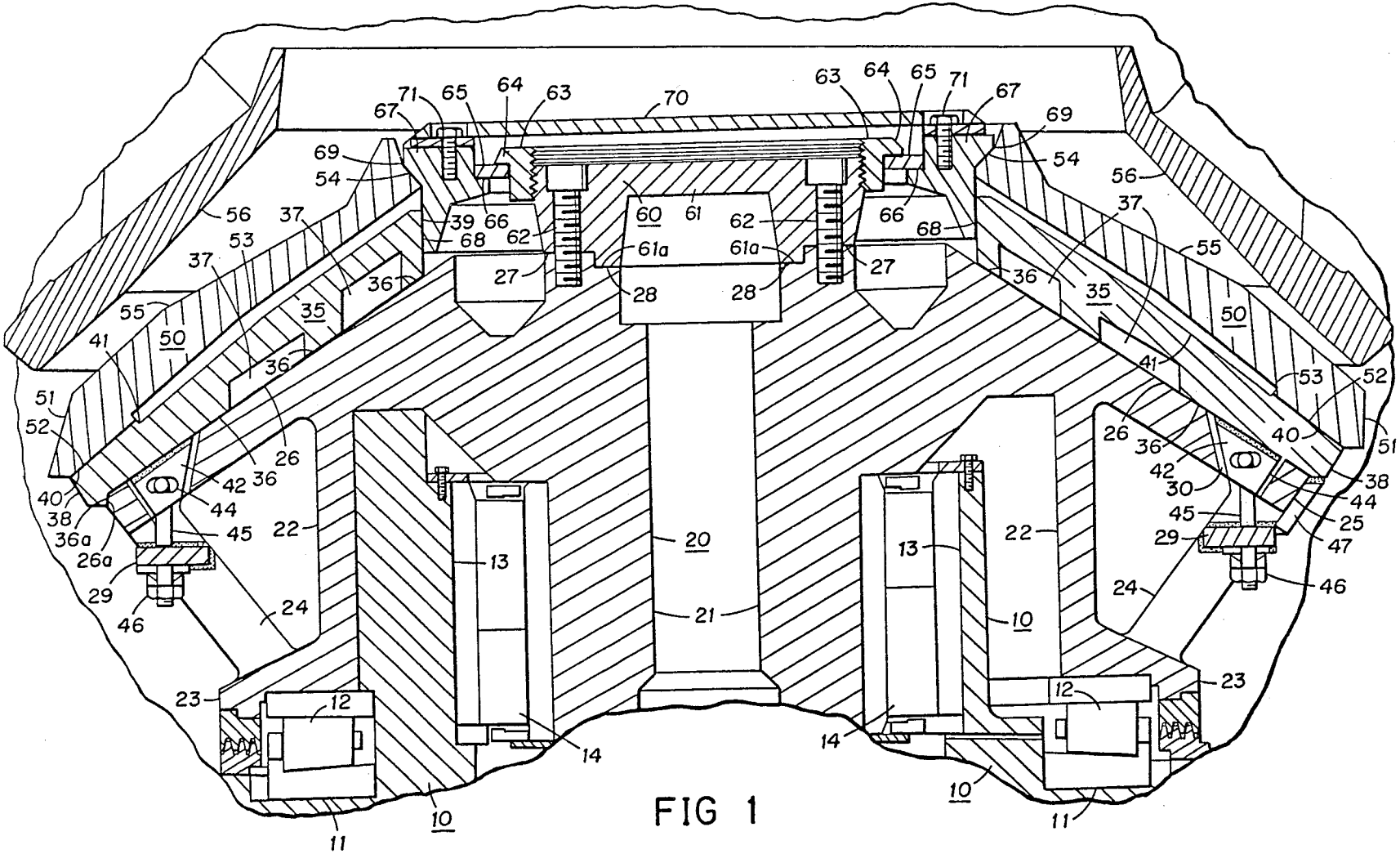
FIG. 1 is a vertical sectional view diametrically through a portion of a typical cone crusher illustrating the fine head adapter and mantle in operative position on the head.
Figure 2:
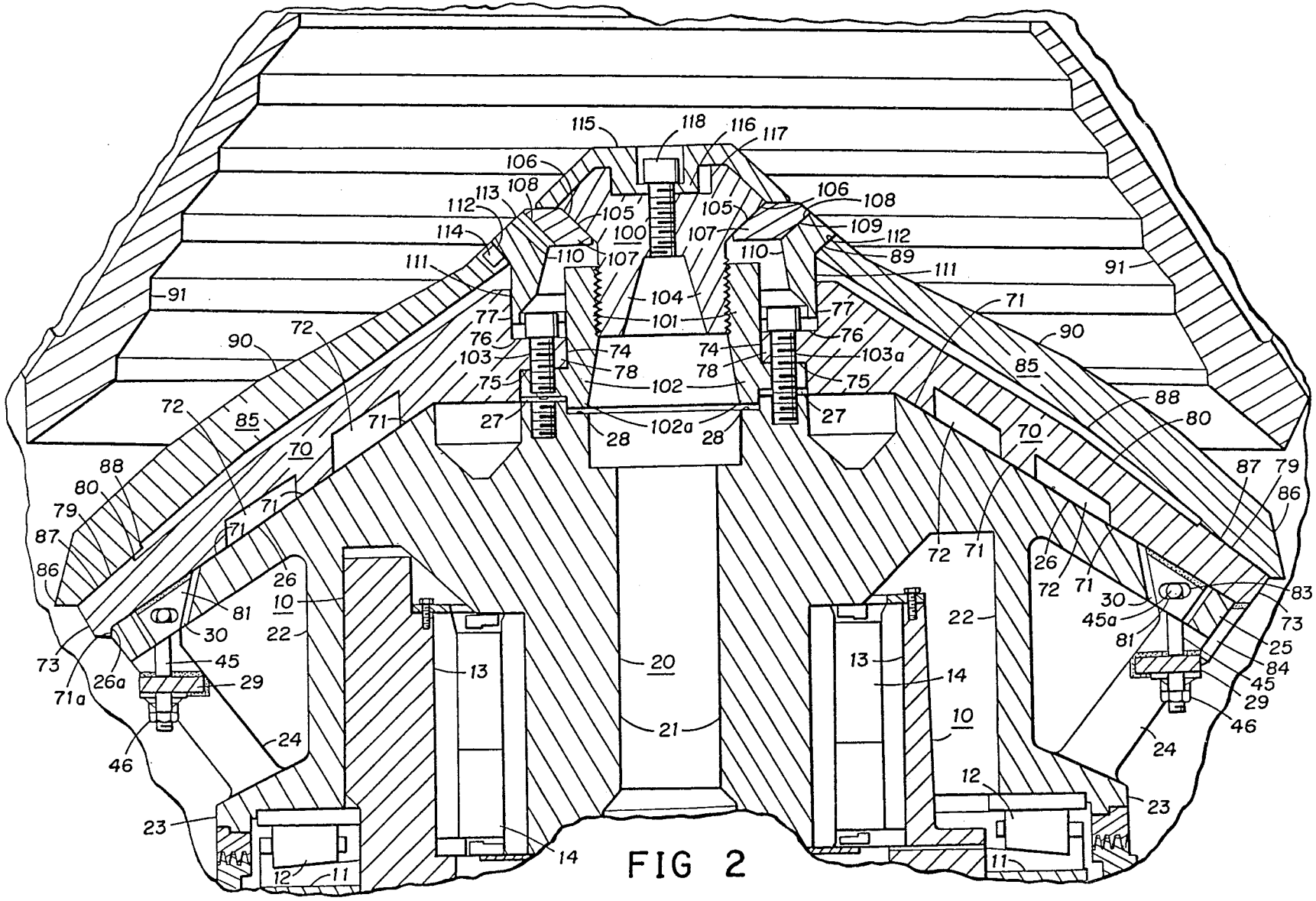
FIG. 2 is similar to FIG. 1 but illustrates the coarse head adapter and mantle in operative position on the head.
Figure 3:
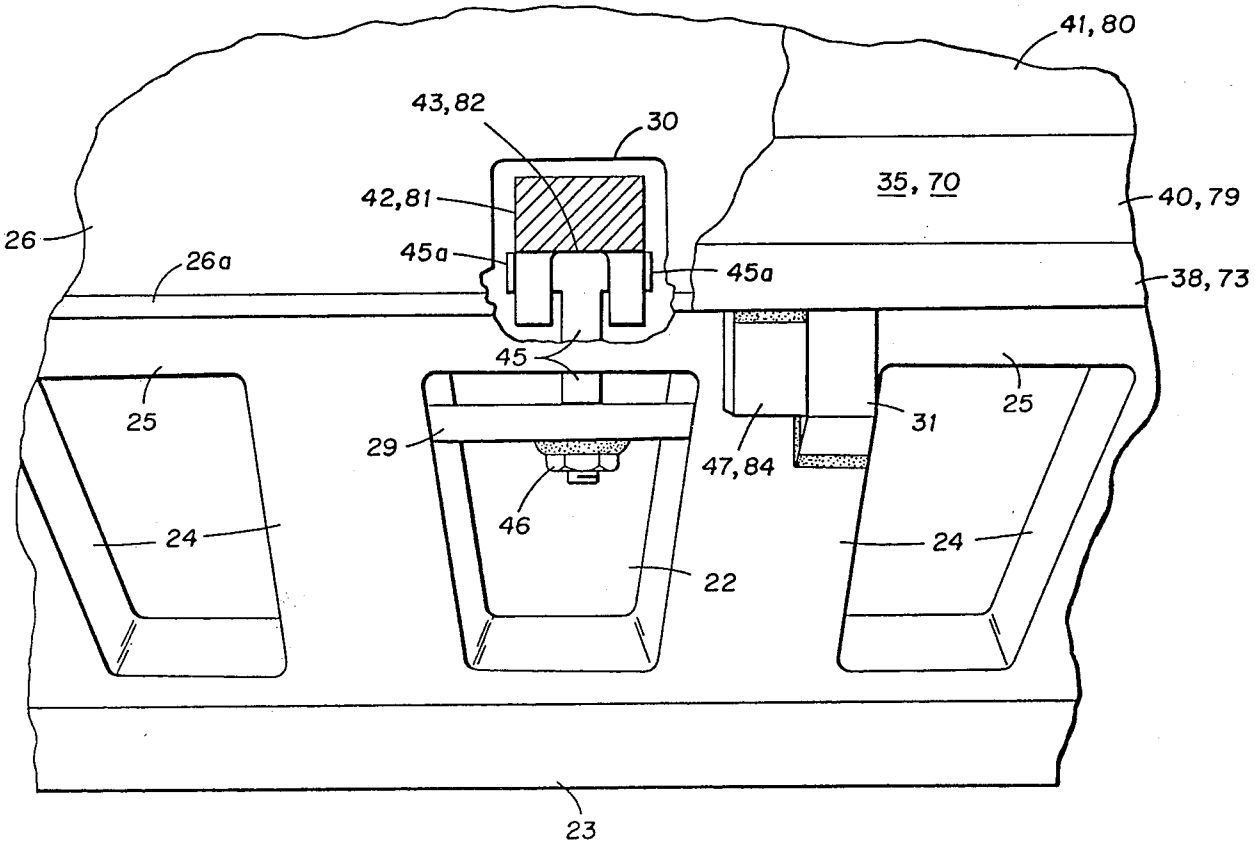
FIG. 3 is a partial side elevational view of the skirt of the head shown in FIGS. 1 and 2 and further illustrates the manner of attachment of the skirt of each adapter to the skirt of the head.

The cone crusher illustrated is of the construction described and shown in FIG. 6 of U.S. Pat. No. Re. 27,970 and in U.S. Pat. Nos. 3,337,143 and 3,759,453, though the invention is equally adaptable to cone crushers of other constructions. Briefly, so far as is pertinent here and as shown in FIGS. 1 and 2 hereof, the crusher includes a large configured cam member 10 provided with an annular camming surface 11 and roller thrust bearing 12. The cam member 10 is driven about its axis in the manner shown in the foregoing patents, and is provided at its upper end with a large open well 13 in which is fitted a radial roller bearing 14. The stock crusher fine head, generally designated at 20, comprises a large integral casting having a depending boss 21 received and rotating in the bearing 14, the boss 21 being spacedly encompassed by an annular wall 22 whose lower end provides a base 23 which rotates on the bearing 12 and supports the head 20. A number of spaced webs 24 angle outwardly and upwardly from the base 23 and support the lower end or skirt 25 of a machined, frusto-conical exterior head surface 26 co-axial with the head 20, the lower end of the head surface 26 being vertically angled at **26*a* to form an annular lip for reasons soon to appear. The upper or truncated end of the head surface 26 is provided with a flat annular end face 27 normal to the co-axis of the head 20 and surface 26. The modifications to the head 20 consist of an inner counterbore of the end face 27 to form a shoulder 28. Then between adjacent webs 24 are welded four pairs of diametrically opposite adapter anchor plates 29 (only two being shown) equally spaced about the skirt 25, the latter above each plate 29 being apertured at 30 up through the head surface 26. Finally, a lug 31 (see FIG. 3) is welded to the skirt 25 and one of the webs 24** for purposes to be described.

Turning first to FIG. 1 in particular, the fine head adapter, generally designated at 35, is of annular, frustoconical configuration whose inner and outer slant heights are substantially equal to that of the head surface 26 and co-axial therewith. The adapter 35 is cast from mild steel and its inner co-axial surface 36 machined for face-to-face contact with the head surface 26, the lower end of the adapter surface 36 being vertically angled at **36*a* to form an annular lip which mates with the lip 26*a* in order to pilot the adapter 35 onto and help locate it relative to the head surface 26. The upper portion or so of the adapter surface 36 is provided with several annular reliefs 37 intermediate its lower end or skirt 38 and its upper end, the latter end being machined to form an annular face 39 parallel to the co-axis of the head 20 and adapter 35. The exterior of the adapter 35 adjacent its skirt 38 is further machined to form an annular mantle seat 40 co-axial with the head 20 and adapter 35, the remainder of the exterior of the adapter 35 being relieved at 41. At diametrically opposite locations four pairs of configured anchor blocks 42 (only two being shown), spaced to coincide with the head surface apertures 30, are welded to the inner adapter surface 36 adjacent its skirt 38. The blocks 42 angle down through the head surface apertures 30 and are slotted radially of the head 20 at 43 and then transversely at 44 in order to allow the insertion of the cross ends 45*a* to T-bolts 45 in the slots 44. The T-bolts 45 extend down through the anchor plates 29 and are secured by nuts 46 turned up to wedge the adapter skirt 38 down onto the head 20. It should be noted that the apertures 30 are sufficiently large relative to the blocks 42 so as to permit some freedom of movement of the adapter skirt 38 relative to the head 20. Finally, a lug 47 is welded beneath the overhang of the adapter skirt 38 in side-by-side abutment with the lug 31 on the head 20**.

The fine head mantle 50, also of annular frusto-conical shape and co-axial with the head 20 and adapter 35, is cast from a suitable manganese steel, its inner surface adjacent its skirt 51 being machined to provide an annular seat 52 for face-to-face contact with the exterior seat 40 of the adapter 35. Above the seat 52 the inner surface of the mantle 50 is relieved at 53 as shown and terminates at its upper end in a flared annular face 54 just above the adapter end face 39. The exterior mantle surface 55, of course, is configured appropriately for cooperative operation with the fine bowl liner 56 spaced above it. The cavity formed between the adapter and mantle reliefs 41 and 53 is filled with an appropriate epoxy resin in the customary manner, the surface of the adapter relief 41 being first oiled so that the adapter 35 and mantle 50 can be separated for replacement purposes.

The mantle 50, in turn, is wedged down onto the adapter 35 by means of a hold-down assembly generally indicated at 60. This consists of a large squat adapter nut 61 having a lower annular end and boss **61*a* seating upon the head end face 27 and piloted into the shoulder 28, being retained by a surround of six bolts 62 tapped into the end face 27. There are twelve such tappings into the end face 27 (for purposes later described) but only every other one is used for the nut 61. The upper end of the adapter nut 61 is exteriorally threaded to receive a large mantle hold-down nut 63 having an exterior lip 64 at its upper end which overlaps a torch ring 65 circumventing the mantle nut 63. The torch ring 65, in turn, overlies an inner shoulder 66 machined on a radially adjacent mantle washer 67 whose outer periphery is machined with a pair of angled faces 68 and 69 which mate against the adapter and mantle end faces 39 and 54 respectively. The upper end of the mantle washer 67 is then closed by a wear resistant distributor plate 70 secured by bolts 71**.

By turning down the mantle nut 63, it will be evident that the mantle washer 67 therefore presses down and outwardly on the adjacent mantle end face 54 and so urges the exterior adapter and inner mantle skirt seats 40 and 52, as well as the head and adapter surfaces 26 and 36, into tight engagement with each other. In addition, the lips **26*a*, 36*a* and the boss 61*a* serve to restrain shifting of the adapter 35 and mantle 50 on the head 20. As is well known, owing to the rotation of the cam member 20 there is nevertheless some rotary migration of the mantle 50 relative to the adapter 35 during crushing so that before bolting the distributor plate 70 in place, the mantle nut 63, torch ring 65, mantle washer 67, and mantle 50 are appropriately connected to each other so that such migration tends to tighten rather than loosen the mantle nut 63 on the adapter nut 61, the hand of the threads of the latter relative to the direction of rotation of the cam member 20 being appropriate for this purpose. This may be accomplished, for instance, by means of several slots cut into the lip 64 of the mantle nut 63 from which short steel lugs extend radially to abut the mantle washer 67, the lugs being then welded to the nut 63, ring 64 and washer 67, the latter in turn being keyed to the mantle 50. The two lugs 31 and 47 are also appropriately positioned relative to each other to prevent what would otherwise for the same reason be a similar migratory tendency of the adapter 35 relative to the head 20**.

Turning next to FIG. 2 in particular, the coarse head adapter, generally designated at 70, is also of annular, frustoconical configuration whose exterior slant height is substantially greater than that of the head surface 26 and coaxial therewith. The adapter 70 is also cast from mild steel and its inner coaxial surface 71 machined for face-to-face contact with the head surface 26, the lower end of the adapter surface 71 also being vertically angled at **71*a* to form an annular lip which mates with the lip 26*a* in order to pilot the adapter onto and help locate it relative to the head 20. The upper portion or so of the adapter surface 71 is likewise provided with several annular reliefs 72 intermediate via its lower end or skirt 73 and its upper end. The latter end overlies the upper end face 27 of the head 20 and is machined to provide an annular throat 74 parallel to the axis of the head 20 and adapter 70. The under and top sides of the throat 74 are counterbored to form a lower shoulder 75 and an upper shoulder 76, the latter having a surrounding wall 77 parallel to the co-axis of the head 20 and adapter 70, whereby the shoulders 75 and 76 constitute an intermediate lip 78 spacedly overhanging the end face 27. The exterior of the adapter 70 adjacent its skirt 73 is further machined to form an annular mantle seat 79 coaxial with the head 20 and adapter 70, the remainder of the exterior of the adapter 70 being relieved at 80. At diametrically opposite locations four pairs of depending anchor blocks 81 (only two being shown), identical in shape and location to the blocks 42 of the fine adapter 35, are welded to the inner adapter surface 71** adjacent its skirt 73 which, like the blocks 42, angle down through the head surface apertures 30. The anchor blocks 81 are similarly slotted at 82 and 83 and are employed with the anchor plates 29 and the T-bolts 45 and nuts 46 of the fine adapter 35 to wedge the adapter skirt 73 down onto the head 20 in the same manner. Finally, a lug 84, similar to the lug 47 of the fine adapter 35 and serving the same function, is welded beneath the overhang of the adapter skirt 73 in side-by-side abutment with the lug 31 on the head 20.

The coarse head mantle 85 is also of annular, frusto-conical shape and coaxial with the head 20 and adapter 70 and also cast from a suitable manganese steel, its inner surface adjacent its skirt 86 being machined to provide an annular seat 87 for face-to-face contact with the exterior adapter seat 79. Above the seat 87 the inner surface of the mantle 85 is relieved at 88 as shown and terminates at its upper end in a flared annular face 89 above the adapter lip 78. The exterior mantle surface 90 is appropriately configured for cooperative operation with the coarse bowl liner 91 spaced above it, and the cavity formed between the adapter and mantle reliefs 80 and 88 is likewise filled with an appropriate epoxy resin in the same manner and for the same purposes as the fine adapter 35 and mantle 50.

The mantle 85 is likewise wedged down onto the head 20 by means of an alternate hold-down assembly generally indicated at 100. This consists of a large, elongated adapter nut 101 of annular shape having a flanged lower end 102 which fits between the head end face 27 and the adapter lip 78, being spaced slightly above the former. The flange 102 also includes a depending boss 102*a* which pilots the nut 101 into the head shoulder 28. The lip 78 and flange 102 are bored through at twelve locations in alignment with the twelve tappings into the head end face 27. Every other one of the bores in the flange 102 is also tapped and, as normally set up, receives a surround of six bolts 103, one of which is shown to the left in FIG. 2. In the event operating conditions require, six additional but longer bolts 103*a*, one of which is shown to the right in FIG. 2, may be also used which are turned down into the respective tappings in the head end face 27. The upper end of the adapter nut 101 is internally threaded to receive the lower threaded end of a large mantle bolt 104 whose periphery above its threads is flared to provide an overhanging flared annular face 105. The latter face engages the inner angled face 106 of a torch ring 107 whose outer angled face 108 in turn engages a mating face 109 on the inner periphery of a mantle washer 110 spacedly surrounding the upper portion of the adapter nut 101 and the bolts 103 (103*a*). The lower outer peripheral face 111 of the mantle washer 110 at the same time engages the wall 77 above the adapter lip 78, while the outer periphery of the washer 110 is provided with a flared annular face 112 which engages the mantle end face 89. Hence, turning down the mantle bolt 104 will urge the mantle 85 down upon the adapter 70 in a manner similar to that in the case of the fine adapter 35 and mantle 50. Similarly, the lips 26*a*, 71*a* and the boss 102*a* restrain shifting of the adapter 70 and mantle 85 on the head 20. The torch ring 107 is keyed to the mantle washer 110 at 113 and the latter to the mantle end face 89 at 114 which thus tends to tighten rather than loosen the bolt 104 during rotary migration of the mantle 85 relative to the adapter 70, as further explained in the case of the fine adapter 35 and mantle 50. Finally, the upper end of the bolt 104 is closed by a dished protector cap 115 whose outer periphery sits atop the torch ring 107, the cap 115 having an offset depending boss 116 fitting within a well 117 in the top of the bolt 104. The cap 115 is secured by a bolt 118 disposed in an exterior counterbore in the boss 116 and tapped into the bolt 104.

Accordingly, by removing the T-bolts 45, distributor plate 70 and bolts 62 in the case of the fine adapter 35 and mantle 50, and the T-bolts 45 only in the case of the coarse adapter 70 and mantle 85 when only the bolts 103 are necessary, either adapter and mantle as a unit can be readily lifted off the head 20 and replaced with the other after removal of the respective bowl liner 56 or 91 and their frames. As previously noted, the foregoing can be accomplished in the field without the time and hazards involved in removing the entire head and without the investment required to have two entirely separate heads on hand. Were the adapters 35 and 70 not used, and the mantles 50 and 85 for instance so configured as to fit directly upon the head 20, it would be difficult, indeed often very difficult, and thus time consuming to remove one or the other from the head 20 when a change from coarse to fine operation, or vice versa, were to be made. The situation would then be analogous to that typically currently presented in the field when a used mantle must be removed from the head for replacement. As is well known, despite oiling of the head surface, there is usually some bonding of the epoxy to the head, as well as corrosion and liming between the mantle and the head, plus distortion of the mantle itself, and so forth, all of which greatly aggravate the effort and time required for removal. The situation would thus be the same in the absence of the adapters 35 and 70, and that is the chief reason for their use. Careful mating between the head surface 26 and the adapter surfaces 36 and 71 allows either adapter and its associated mantle to be readily removed as a unit with none of the problems encountered when a mantle is applied directly to the head. Finally, it might be noted, the hold-down assemblies 60 and 100 are not critical to the invention in the sense that other arrangements for this purpose could be readily employed, as will be apparent to those skilled in the art. Hence, though the present invention has been described in terms of a particular embodiment, being the best mode known of carrying out the invention, it is not limited to that embodiment alone. Thus, the following claims are to be read as encompassing all adaptations and modifications of the invention falling within its scope and spirit.

I claim:

1. In a crusher of the cone type including a gyratory head having an exterior generally frusto-conical surface coaxial therewith and uprightly disposed with upper and lower ends, the distance along said surface between said ends thereof defining the slant height of said surface, the head terminating in a truncated end portion adjacent the upper end of said head surface, the improvement comprising: a generally frusto-conical annular mantle adapter for the head having upper and lower ends, the adapter being disposable upon the head in coaxial sandwiched relation between said head surface and a generally frusto-conical annular mantle having upper and lower ends corresponding respectively to said ends of the adapter, the adapter including an interior generally frusto-conical surface coaxial therewith having upper and lower ends, the distance along said interior adapter surface between said ends thereof defining the slant height of said interior adapter surface, said ends thereof being effective to support the adapter upon said head surface by face-to-face contact between said head and adapter surfaces at a plurality of spaced locations including the upper and lower ends of both surfaces when the adapter is disposed upon the head as aforesaid, the adapter also including an exterior generally frusto-conical surface having upper and lower ends, the distance along said exterior adapter surface between said ends thereof defining the slant height of said exterior adapter surface, said exterior adapter surface being coaxial with the adapter adjacent said lower end thereof effective to support the lower end of the mantle by face-to-face contact between said exterior adapter surface and an interior frusto-conical surface disposed adjacent the lower end of the mantle; lower releasable means operative between the lower ends of the adapter and the head to force said head surface and interior adapter surface into tight engagement with each other; and upper releasable means operative against the upper end of the mantle to force said exterior adapter surface and interior mantle surface into tight engagement with each other.

2. The crusher of claim 1 wherein the exterior slant height of the adapter is greater than the slant heights of said head surface and said interior surface of the adapter such that the upper end of the adapter at least partially overlies said head end portion when the adapter is disposed upon the head as aforesaid.

3. The crusher of claim 2 wherein the adapter and mantle are removable from the head as a unit upon release of the lower releasable means and without need to release the upper releasable means.

4. The crusher of claim 3 wherein the lower releasable means comprises: a plurality of apertures spaced peripherally about and adjacent the lower end of said head surface and opening down therethrough, the head further including a corresponding plurality of first anchor members secured to the head below said surface and accessible through said apertures, the adapter including a corresponding plurality of second anchor members secured to and depending from said interior adapter surface, each of the second anchor members being disposed in one of said apertures and further including connecting means for releasably connecting corresponding first and second anchor members when the adapter is disposed upon the head as aforesaid effective to tighten said contact between said head and adapter surfaces.

5. The crusher of claim 4 wherein the head and the adapter are each provided with lugs adjacent the lower ends of said head and interior adapter surfaces, respective lugs of the head and the adapter being disposed to abut each other when the adapter is disposed upon the head as aforesaid effective to prevent rotation of the adapter relative to the head about their aforesaid coaxis.

6. The crusher of claim 3, 4 or 5 wherein the upper releasable means includes a pair of complementary threaded members disposed atop the head and coaxial therewith, one of the threaded members being operatively associated with the mantle and the adapter and the other threaded member being operatively associated with the adapter.

7. The crusher of claim 6 wherein said other threaded member is also operatively associated with the head.

8. The crusher of claim 1 wherein the exterior slant height of the adapter is such that the upper end of the adapter is disposed adjacent the upper end of said head surface when the adapter is disposed upon the head as aforesaid, the adapter and mantle being removable from the head as a unit upon release of the lower releasable means and without need to release the upper releasable means.

9. The crusher of claim 8 wherein the lower releasable means comprises: a plurality of apertures spaced peripherally about and adjacent the lower end of said head surface and opening down therethrough, the head further including a corresponding plurality of first anchor members secured to the head below said head surface and accessible through said apertures, the adapter including a corresponding plurality of second anchor members secured to and depending from said interior adapter surface, each of the second anchor members being disposed in one of said apertures and further including connecting means for releasably connecting corresponding first and second anchor members when the adapter is disposed upon the head as aforesaid effective to tighten said contact between said head and adapter surfaces.

10. The crusher of claim 9 wherein the head and the adapter are each provided with lugs adjacent the lower ends of said head and interior adapter surfaces, respective lugs of the head and the adapter being disposed to abut each other when the adapter is disposed upon the head as aforesaid effective to prevent rotation of the adapter relative to the head about their aforesaid coaxis.

11. The crusher of claim 8, 9 or 10 wherein the upper releasable means includes a pair of complementary threaded members disposed atop the head and coaxial therewith, one of the threaded members being operatively associated with the head and the other threaded member being operatively associated with both the adapter and the mantle.

* * * * *